US011553746B2

(12) United States Patent
Amstutz

(10) Patent No.: US 11,553,746 B2
(45) Date of Patent: Jan. 17, 2023

(54) PROTECTIVE FINGER HEAT GUARD

(71) Applicant: Peter F. Amstutz, Pottstown, PA (US)

(72) Inventor: Peter F. Amstutz, Pottstown, PA (US)

(73) Assignee: Peter F. Amstutz, Pottstown, PA (US)

( * ) Notice: Subject to any disclaimer, the term of this patent is extended or adjusted under 35 U.S.C. 154(b) by 0 days.

(21) Appl. No.: 16/676,554

(22) Filed: Nov. 7, 2019

(65) Prior Publication Data

US 2021/0137189 A1 May 13, 2021

(51) Int. Cl.
*A41D 19/015* (2006.01)
*A41D 13/08* (2006.01)

(52) U.S. Cl.
CPC ..... *A41D 19/01529* (2013.01); *A41D 13/087* (2013.01); *A41D 19/01517* (2013.01)

(58) Field of Classification Search
CPC ..... A41D 19/01529; A41D 19/01517; A41D 13/087
USPC ..... 2/21
See application file for complete search history.

(56) References Cited

U.S. PATENT DOCUMENTS 293,831 A * 2/1884 Wickers ..... A41D 13/087 2/21
513,724 A * 1/1894 Perkins ..... A41D 13/087 30/123.5
2,437,886 A * 3/1948 Millard ..... A41D 19/01517 428/80
3,029,440 A * 4/1962 Nelson ..... A41D 19/01517 2/21
3,386,104 A * 6/1968 Casey ..... A41D 19/01517 2/16
4,454,611 A * 6/1984 Tschirch ..... A41D 19/01529 2/16
4,751,747 A * 6/1988 Banks ..... A41D 19/01529 2/161.8
4,813,082 A * 3/1989 Kallman ..... A41D 19/01 2/160
4,869,962 A * 9/1989 McCullough, Jr. ..... B32B 5/26 428/408
5,093,933 A * 3/1992 Berry ..... A41D 19/01517 2/161.6
5,277,697 A * 1/1994 France ..... A61F 13/062 602/26
5,423,090 A * 6/1995 Gimbel ..... A61B 42/10 2/161.7
5,450,626 A * 9/1995 Sorrels ..... A41D 13/087 2/163
5,706,520 A * 1/1998 Thornton ..... A41D 13/087 2/2.5
5,817,038 A * 10/1998 Orange ..... A61F 13/041 602/62
6,647,549 B2 * 11/2003 McDevitt ..... A41D 13/087 2/21
6,918,137 B2 * 7/2005 Fowler ..... A41D 13/084 2/16
7,000,295 B2 * 2/2006 Andrews ..... D02G 3/12 28/168

(Continued)

*Primary Examiner* — Khaled Annis
*Assistant Examiner* — Dakota Marin

(57) ABSTRACT

A protective finger heat-guard and method of manufacture are disclosed. The protective finger heat guard includes a sleeve formed of a singular woven or non-woven material that defines a protective enclosure for receiving a finger of a user to insulate the finger from high-heat environments, such as during metal joining processes.

7 Claims, 4 Drawing Sheets

(56) References Cited

U.S. PATENT DOCUMENTS 7,284,283 B2 * 10/2007 Mack ..... A41D 19/015 2/16
7,895,671 B2 * 3/2011 Salomon ..... A41D 13/087 2/161.2
8,341,763 B2 * 1/2013 Geyer ..... A63B 71/148 2/21
D685,136 S 6/2013 Collier
D782,118 S 3/2017 Alferez
10,420,381 B2 * 9/2019 Tulloch ..... A41D 13/087
10,834,979 B1 * 11/2020 Gustafson ..... A41D 13/087
2002/0170133 A1 * 11/2002 McDevitt ..... A61F 13/105 15/167.1
2002/0174479 A1 * 11/2002 Markson ..... A41D 19/01529 2/161.6
2005/0241089 A1 * 11/2005 Brunner ..... A47L 13/18 15/104.94
2006/0137069 A1 * 6/2006 Yang ..... A41D 13/087 2/21
2006/0137070 A1 * 6/2006 Yang ..... A41D 13/087 2/21
2008/0022436 A1 * 1/2008 Hull ..... A41D 19/01529 2/161.6
2010/0275341 A1 * 11/2010 Sweeney ..... A41D 19/01505 2/164
2011/0272083 A1 * 11/2011 Yatkowski ..... A41D 19/0024 156/94
2012/0144544 A1 * 6/2012 Telfer ..... A63B 71/14 2/269
2012/0159683 A1 * 6/2012 Jiang ..... B82Y 30/00 2/69
2013/0139294 A1 * 6/2013 Zetune ..... A41D 19/001 2/163
2015/0164158 A1 * 6/2015 Veillet ..... A41D 19/001 2/161.6
2016/0100637 A1 * 4/2016 Anderson ..... A41D 19/0024 2/161.8
2017/0119069 A1 * 5/2017 Alferez ..... A41D 19/01529
2018/0199642 A1 * 7/2018 Clark ..... A41D 19/01529

* cited by examiner

PROTECTIVE FINGER HEAT GUARD

FIELD OF THE DISCLOSURE

The present disclosure relates generally to thermal protection for users operating in high temperature environments, and more particularly, to a protective finger heat guard for thermally insulating the finger of a user during metal joining processes.

BACKGROUND

Heat energy is utilized for joining metal parts, such as, for example, by welding, brazing or soldering. Typically, portions of the metals to be joined are heated up to a suitable temperature and/or molten materials are added to form a strong permanent metal joint.

Examples of known heat shields and finger guards used in such high-temperature environments are disclosed in U.S. Pat. No. 3,908,197, U.S. Patent Application Publication Nos. 2017/0119069, US 2018/0199642; and U.S. Design Pat. Nos. D685,1365 and D782,1185. All of these configurations have numerous disadvantages—they are oversized, bulky and difficult to control during critical steps of the welding process where an extra level of control is often needed to stabilize the work pieces being joined. It is well understood that the look, feel and quality of the final welds/joint, and the ultimate performance of the joined materials, is highly dependent on how steady an operator is able to maintain the work pieces and tools during the joining process. Experienced welders nearly universally use welding gloves to protect their hands from excessive heat and occasional spatter of molten material inherent in the welding process. However, while welding gloves provide a reasonable level of protection against such heat and material spatter, they eventually tend to wear our and overheat a portion of the hand used to prop or align the work during extended weld bead runs. There are significant trade-offs between dexterity, protection and service life offered by a high-quality welding glove alone. Prolonged exposure to high heat conditions will inevitably burn through even the best gloves, thereby shortening their useful service life or otherwise overheating the welder's hand to the point where they may have to stop an incomplete weld.

Accordingly, there is a need in the art for a superior protective finger heat guard that may be used alone and in combination with welding gloves to overcome the inherent shortcomings in using welding gloves alone during high-heat metal joining processes.

BRIEF DESCRIPTION OF THE DRAWINGS

The accompanying drawings provide visual representations which will be used to more fully describe various representative embodiments and can be used by those skilled in the art to better understand the representative embodiments disclosed and their inherent advantages. The drawings are not necessarily to scale, emphasis instead being placed upon illustrating the principles of the devices, systems, and methods described herein. In these drawings, like reference numerals may identify corresponding elements.

DETAILED DESCRIPTION

Figure 1:
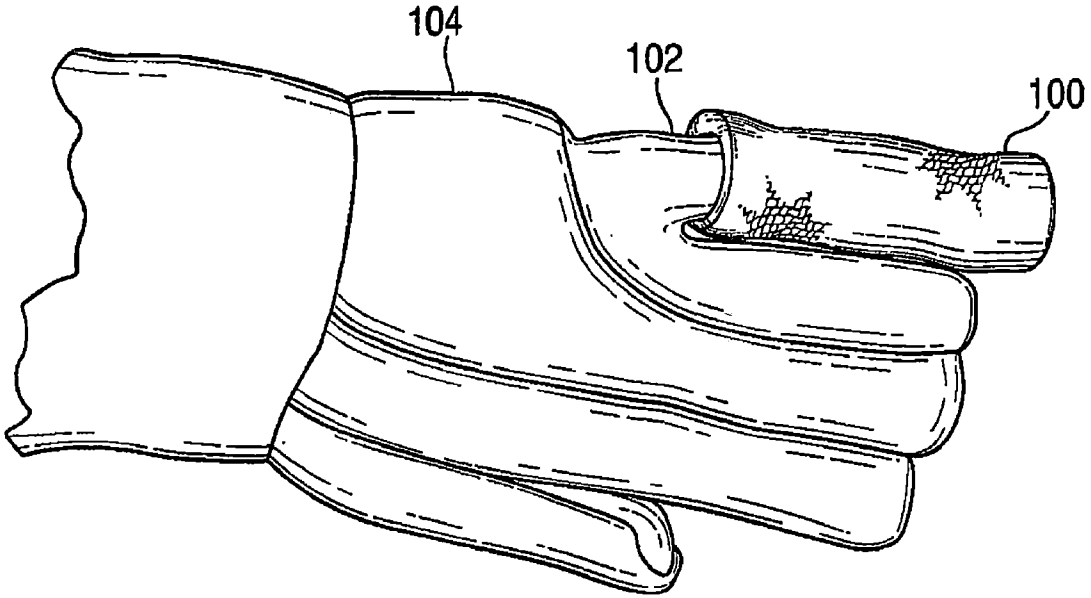
FIG. 1 is an illustration of a protective finger heat guard as worn over a finger portion of a welding glove in accordance with an embodiment of the disclosure.

Specific embodiments of the disclosure will now be described in detail with reference to the accompanying figures. While this disclosure is susceptible of being embodied in many different forms, there is shown in the drawings and will herein be described in detail specific embodiments, with the understanding that the present disclosure is to be considered as an example of the principles of the disclosure and not intended to limit the disclosure to the specific embodiments shown and described. In the description below, like reference numerals may be used to describe the same, similar or corresponding parts in the several views of the drawings.

All documents mentioned herein are hereby incorporated by reference in their entirety. References to items in the singular should be understood to include items in the plural, and vice versa, unless explicitly stated otherwise or clear from the text.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

In accordance with an embodiment of the disclosure, there is provided a protective finger heat-guard that includes a sleeve formed of a singular woven or non-woven material. The sleeve is constructed and arranged to define a protective enclosure therein for receiving a finger of a user to insulate the finger from high-heat environments.

In accordance with a further embodiment, the sleeve material consists of at least one of fiberglass, basalt, silica, metal wire, metal foil, aramid fiber, and meta-aramid fiber.

In accordance with yet another embodiment, the sleeve material is coated with at least one of silicone and silanes.

In accordance with still another embodiment, the sleeve material is coated with one or more metal ion organic compounds: acrylic, polyimide (PI), polyamide (PA), PTFE, Vermiculite, Nylon, PET, PETE, PPS, PSU, PPSU, PES, PEEK, PEK, and PAI.

In accordance with another embodiment, the protective finger heat-guard further includes a sequential or blended coating.

In accordance with still another embodiment, the sleeve material includes flame-retardant additives.

In accordance with yet a further embodiment, the sleeve has a diameter in the range of approximately 5.0 mm to 150 mm, and a length of approximately 0.5 to 100 times the diameter.

In accordance with another embodiment, the sleeve is tubular with one closed end thereof.

In accordance with a further embodiment, the sleeve is tubular with opposite ends thereof folded into an inner bore of the sleeve to define a cavity for receiving the finger of the user of a suitable depth for an intended application.

In accordance with another embodiment, there is provided a method of manufacture of a protective finger heat-guard. The method includes taking a cylindrical sleeve of a singular woven or non-woven material having an inner bore, folding over a first end thereof into the bore of the sleeve, and folding over a second end thereof into the bore opposite the first end to define a protective enclosure therein for receiving a finger of a user to insulate the finger from high-heat environments.

In accordance with a further embodiment, the method further includes inserting a tool into the first end of the sleeve to push the folded first end thereof into the bore, and subsequently inserting the tool into the second end of the sleeve to push the folded second end thereof into the bore.

In accordance with still a further embodiment, there is provided a method of manufacture of a protective finger heat-guard. The method includes taking a cylindrical sleeve of a singular woven or non-woven material having an outer surface and an inner bore, folding over a first end thereof into the bore of the sleeve, folding over a second end thereof opposite the first end over an outer surface of the sleeve to form an overlapping portion, and joining the overlapping portion to an outer surface of the sleeve to define a protective enclosure therein for receiving a finger of a user to insulate the finger from high-heat environments. The overlapping portion may be joined by stitching, bonding or the like.

With reference now to FIG. 1, there is shown a protective finger heat guard 100 in accordance with an embodiment of the disclosure as worn in a typical high-temperature metal joining application. The protective finger heat guard 100 is disposed over a finger portion 102 of a welding glove 104.

Figure 2:
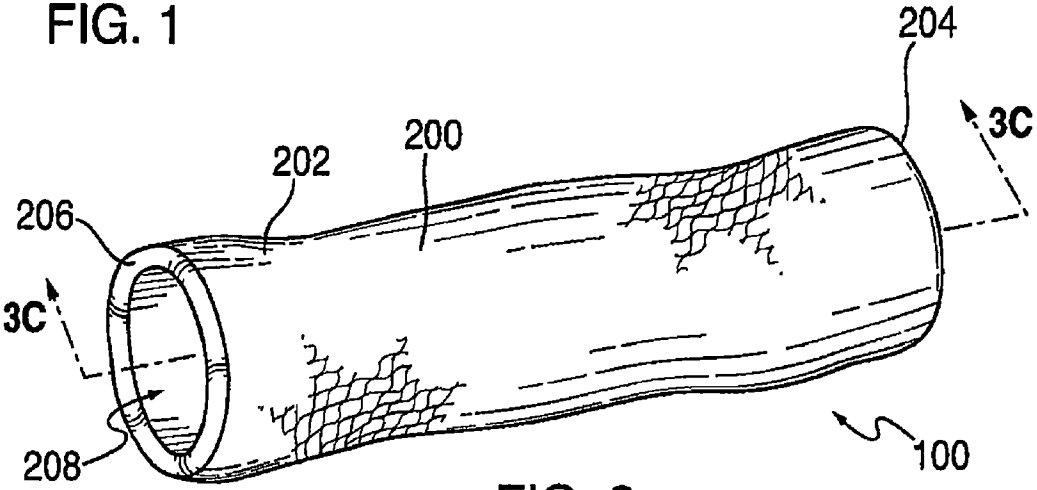
FIG. 2 is an isometric view of the finger protective heat guard.

FIG. 2 is an isometric view of the protective finger heat guard 100 shown in FIG. 1. The protective finger heat guard 100 is constructed and arranged as a sleeve 200 formed of a singular woven or non-woven material. The sleeve provides a protective enclosure therein for receiving the finger of a user to insulate the finger from high-heat environments as shown in FIG. 1. The sleeve is defined by an outer surface 202, a first side 204, a second side 206, and an inner bore 208. In accordance with embodiments of the disclosure, the sleeve material consists of at least one of fiberglass, basalt, silica, metal wire, metal foil, aramid fiber, and meta-aramid fiber. In accordance with yet another embodiment, the sleeve material can be coated with at least one of silicone and silanes. In accordance with still another embodiment, the sleeve material is coated with one or more metal ion organic compounds: acrylic, polyimide (PI), polyamide (PA), PTFE, Vermiculite, Nylon, PET, PETE, PPS, PSU, PPSU, PES, PEEK, PEK, and PAI. In accordance with another embodiment, the protective finger heat-guard further includes a sequential or blended coating. In accordance with still another embodiment, the sleeve material can include flame-retardant additives.

In accordance with an embodiment, the sleeve is configured with a diameter in the range of approximately 5.0 mm to 150 mm, and a length of approximately 0.5 to 100 times the diameter.

Figure 3A:
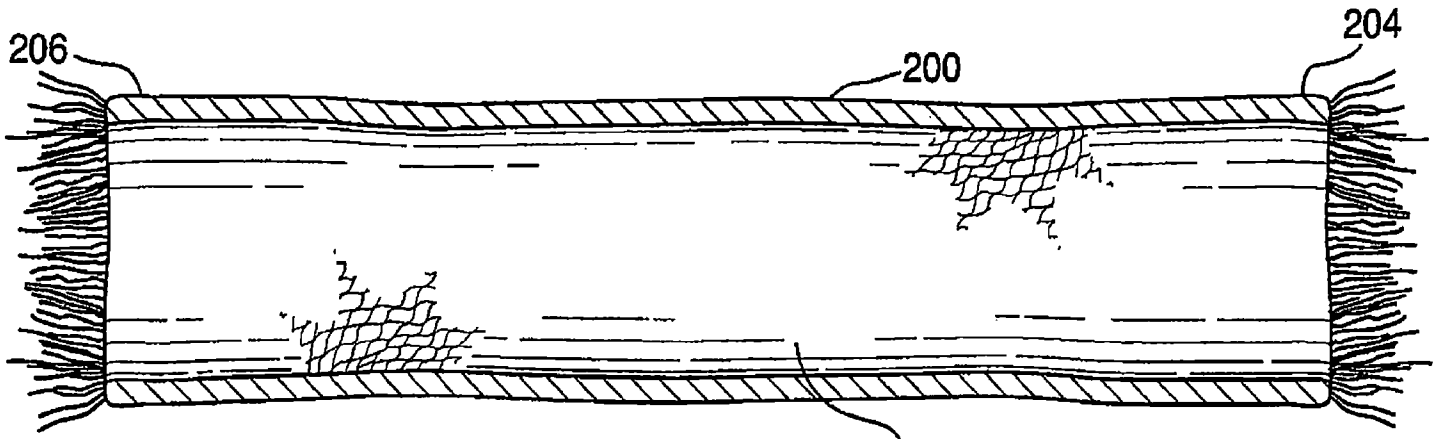
FIGS. 3A-3C are sectional views of a manufacturing process for the finger protective heat guard and details of construction in accordance with an embodiment of the disclosure.
Figure 3B:
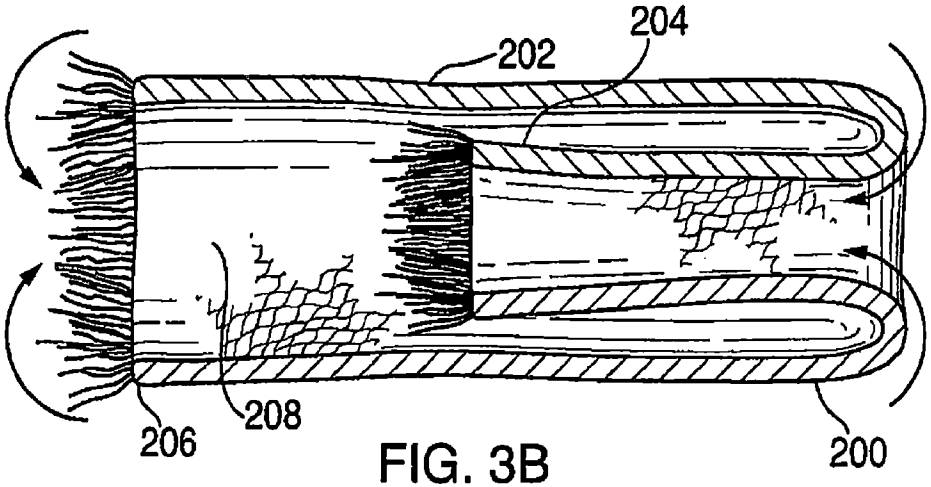
Figure 3C:
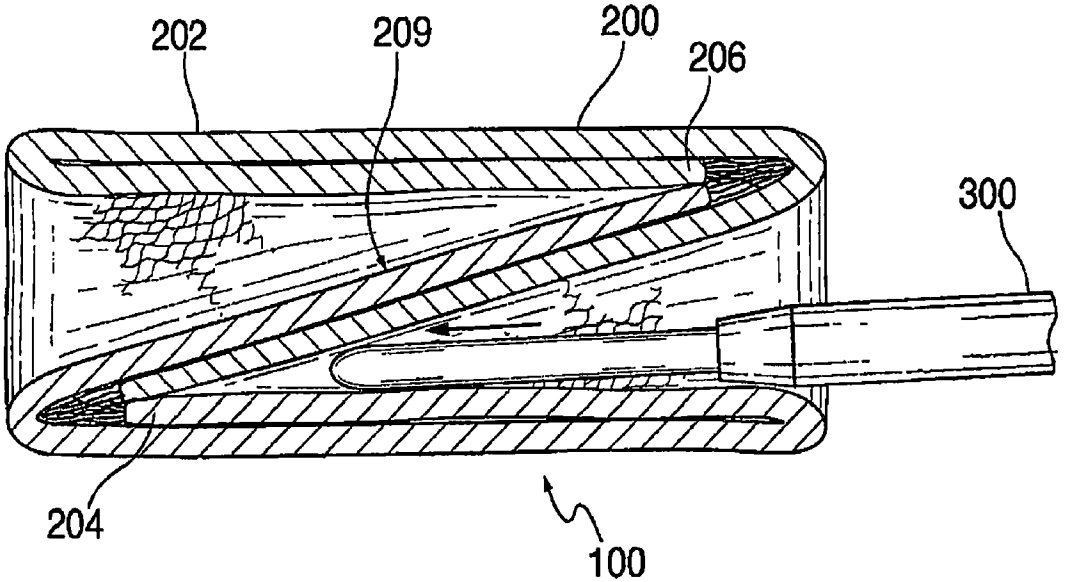

FIGS. 3A, 3B and 3C are sequential sectional views showing a manufacturing method for constructing the protective finger heat guard 100 shown in FIGS. 1 and 2. FIG. 3C is a sectional view of the completed protective finger heat guard 100 along lines 3C-3C as depicted in FIG. 2. In FIG. 3A there is illustrated a generally cylindrical sleeve of material (as described above) prior to folding the respective first and second ends thereof, 204, 206. Here, the sleeve material may be unfinished having fringed or frayed portions on each end as shown in the drawing. In FIG. 3B, the first end 204 has been folded into the inner bore 208 along the fold lines illustrated in the figure. The folding process may be implemented or assisted by use of a tool 300 as generally shown in FIG. 3C. The second end 206 is similarly folded into the inner bore 208 of the sleeve 200 to form a completed assembly. This method may be referred to as a "double-tuck" fabrication example, where both sides 204, 206 are folded into inner bore 208 to form a pair of overlapping pockets that extend from each end of the sleeve 200 and form a protective barrier 209 that prevents a finger that may be inserted from either end from extending through an opposing end of the sleeve 200 from which the finger was inserted to thereby form the completed protective finger heat guard 100 as depicted in FIG. 1.

Figure 4A:
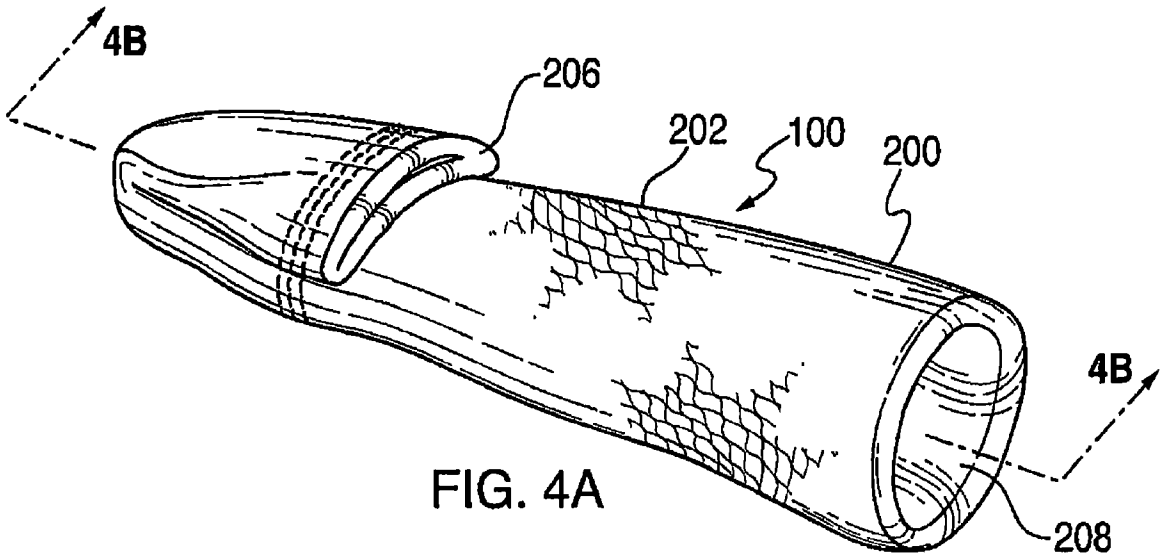
FIG. 4A is an isometric view of a finger protective heat guard in accordance with an embodiment of the disclosure.
Figure 4B:
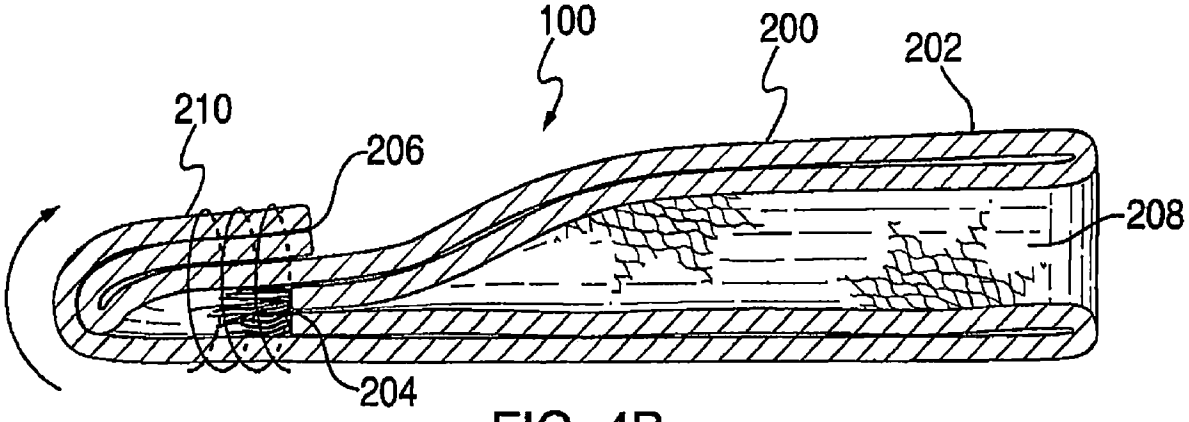
FIG. 4B is a sectional view of the embodiment shown in FIG. 4A.

Referring now to FIGS. 4A and 4B, there is shown another embodiment of a protective finger heat guard 100 that includes a sleeve 200 having the first end thereof 204 folded into the bore 208 as described in the foregoing with respect to the embodiment illustrated in FIGS. 2, and 3A-3C. Here, however, the second end 206 is folded over the outer surface 202 to form an overlapping portion 210. This overlapping portion 210 may be stitched (as shown) to the outer surface 202 of the sleeve 200, or attached by any suitable method such as, for example, bonding or the like.

It will be appreciated that the devices and methods of fabrication disclosed in accordance with embodiments of the disclosure are set forth by way of example and not of limitation. Absent an explicit indication to the contrary, the disclosed devices, systems, and method steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

It will be understood by those skilled in the art that various changes may be made in the form and details of the described embodiments resulting in equivalent embodiments that remain within the scope of the appended claims.

I claim:

1. A protective finger heat-guard, comprising:

A tubular sleeve comprising at least one of a singular woven and non-woven material, the sleeve defining a protective enclosure therein for receiving a finger of a user to insulate the finger from high-heat environments, the sleeve having opposite ends thereof folded into an inner bore of the sleeve to define a pair of inwardly extending and overlapping pockets from the opposite ends of the sleeve for receiving at least one finger of the user from either end of the sleeve, the overlapping pockets forming a barrier that prevents the finger from passing through an opposing end of the sleeve.

2. The protective finger heat-guard of claim 1, where the material consists of at least one of fiberglass, basalt, silica, metal wire, metal foil, aramid fiber, and meta-aramid fiber.

3. The protective finger heat-guard of claim 2, where the material is coated with at least one of silicone and silanes.

4. The protective finger heat-guard of claim 2, where the material is coated with one or more metal ion organic compounds including acrylic, polyimide (PI), polyamide (PA), PTFE, Vermiculite, Nylon, PET, PETE, PPS, PSU, PPSU, PES, PEEK, PEK, and PAI.

5. The protective finger heat-guard of claim 2, where the material consists of a sequential or blended coating.

6. The protective finger-heat guard of claim 1, where the material includes flame-retardant additives.

7. The protective finger-heat guard of claim 1, where the sleeve has a diameter in the range of approximately 5.0 mm to 150 mm, and a length of approximately 0.5 to 100 times the diameter.

* * * * *